US009343858B1

(12) United States Patent
Lu

(10) Patent No.: US 9,343,858 B1
(45) Date of Patent: May 17, 2016

(54) CONNECTOR

(71) Applicant: HON HAI PRECISION INDUSTRY CO., LTD., New Taipei (TW)

(72) Inventor: Li-Chin Lu, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/691,072

(22) Filed: Apr. 20, 2015

(30) Foreign Application Priority Data

Dec. 24, 2014 (CN) ..... 2014 1 0813301

(51) Int. Cl.

| | |
|---|---|
| ***H01R 13/40*** | (2006.01) |
| ***H01R 24/60*** | (2011.01) |
| ***H01R 13/18*** | (2006.01) |
| *H01R 107/00* | (2006.01) |

(52) U.S. Cl.
CPC ..... *H01R 24/60* (2013.01); *H01R 13/18* (2013.01); *H01R 2107/00* (2013.01)

(58) Field of Classification Search
CPC .... H01R 12/721; H01R 13/18; H01R 13/187; H01R 13/4223; H01R 23/7068
USPC ..... 439/660, 592, 593, 637, 839
See application file for complete search history.

(56) References Cited

U.S. PATENT DOCUMENTS

| | | | | | |
|---|---|---|---|---|---|
| 2,706,803 | A * | 4/1955 | Templeton | H01R 13/15 | 439/691 |
| 2,858,515 | A * | 10/1958 | Thunander | H01R 13/26 | 174/138 R |
| 4,933,519 | A * | 6/1990 | Milianowicz | H01H 1/54 | 200/255 |
| 5,059,133 | A * | 10/1991 | Hikami | H01R 12/856 | 439/161 |
| 5,507,651 | A * | 4/1996 | Tanaka | H01R 12/62 | 439/632 |
| 6,572,396 | B1 * | 6/2003 | Rathburn | H01R 12/89 | 439/260 |
| 6,612,872 | B2 * | 9/2003 | Farnworth | H01L 25/0657 | 439/593 |
| 6,923,655 | B2 * | 8/2005 | Korsunsky | H01R 12/85 | 439/637 |

* cited by examiner

*Primary Examiner* — Neil Abrams
*Assistant Examiner* — Travis Chambers
(74) *Attorney, Agent, or Firm* — Novak Druce Connolly Bove + Quigg LLP

(57) ABSTRACT

A connector includes a female connector and a male connector. The female connector includes a first sidewall, two resisting members, and a number of first electrical terminals. Each resisting member includes a base plate. The base plates cooperate with the first sidewall to form a receiving space to receive the male connector. The first electrical terminals are received in the receiving space and secured to the base plates. The male connector includes a supporting plate, a first elastic, and a number of second electrical terminals. The supporting plate defines an inner first hollow portion. The first elastic is received in the first hollow portion and resists opposite inner surfaces of the supporting plate. The first elastic is configured to resile the supporting plate outwardly. The second electrical terminals are attached to opposite outer surfaces of the supporting plate and are configured to electrically contact the first electrical terminals.

20 Claims, 4 Drawing Sheets

CONNECTOR

CROSS-REFERENCE TO RELATED APPLICATIONS

This application claims priority to Chinese Patent Application No. 201410813301.6 filed on Dec. 24, 2014, the contents of which are incorporated by reference herein.

FIELD

The subject matter herein generally relates to connectors, and particularly, to a firmly secured connector.

BACKGROUND

Connectors are commonly employed between two electronic devices or two electronic components to transmit power or signals between the two electronic devices or two electronic components.

BRIEF DESCRIPTION OF THE DRAWINGS

Implementations of the present technology will now be described, by way of example only, with reference to the attached figures.

DETAILED DESCRIPTION

Figure 1:
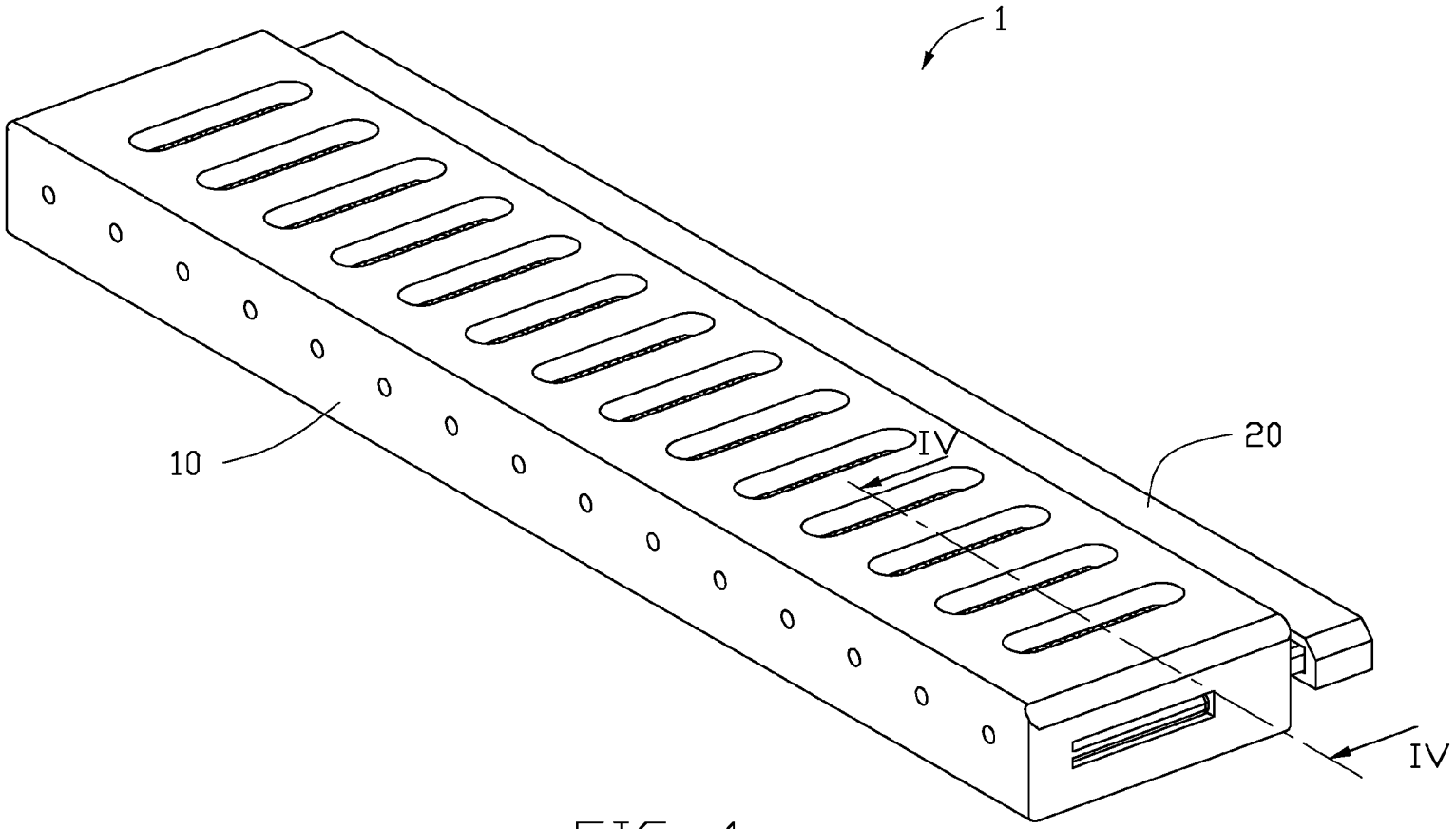
FIG. 1 is an isometric view showing an embodiment of a connector.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" means "including, but not necessarily limited to"; it specifically indicates open-ended inclusion or membership in a so-described combination, group, series and the like.

Embodiments of the present disclosure will be described in relation to the accompanying drawings.

Figure 2:
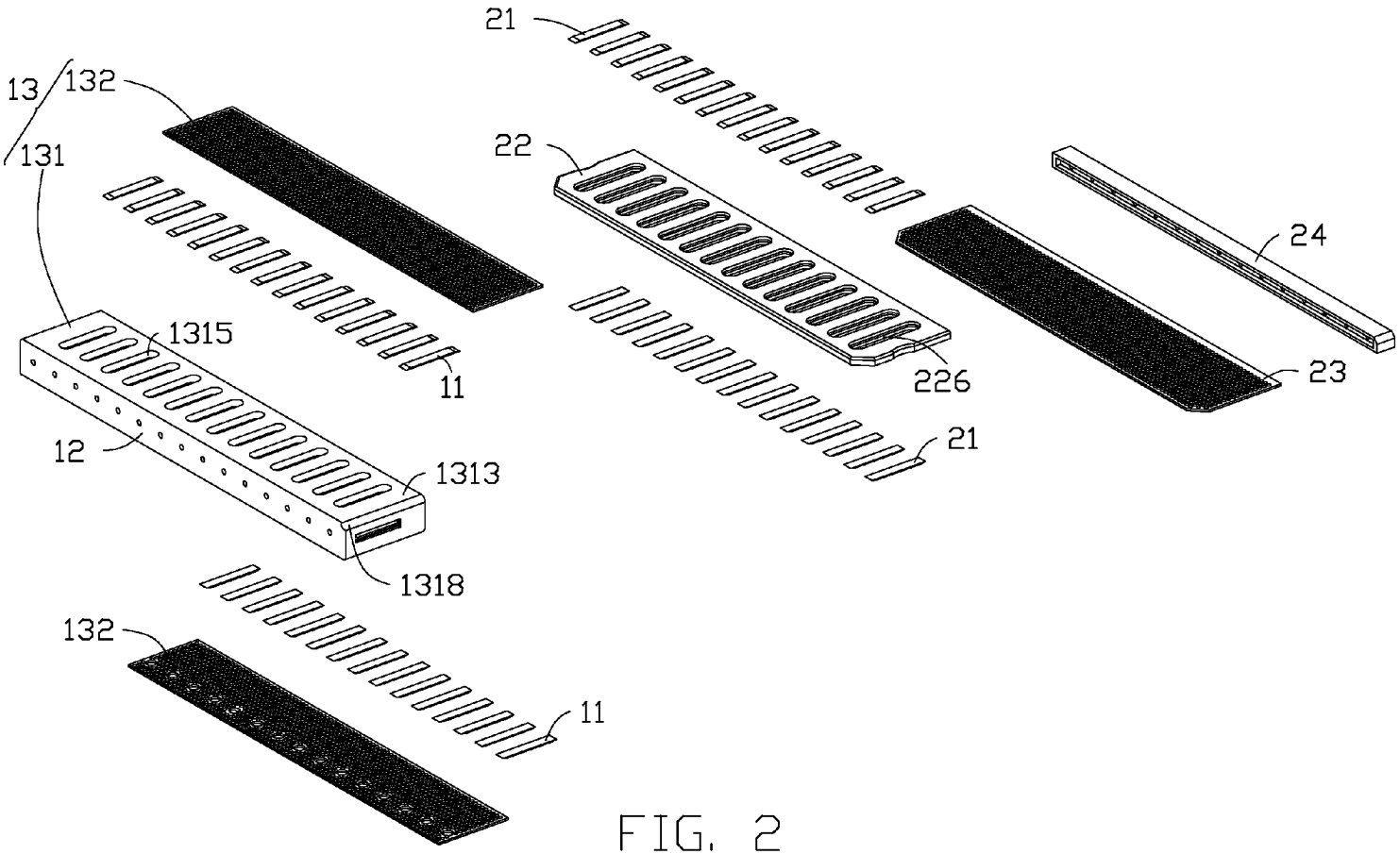
FIG. 2 is an exploded, isometric view showing the connector of FIG. 1.
Figure 3:
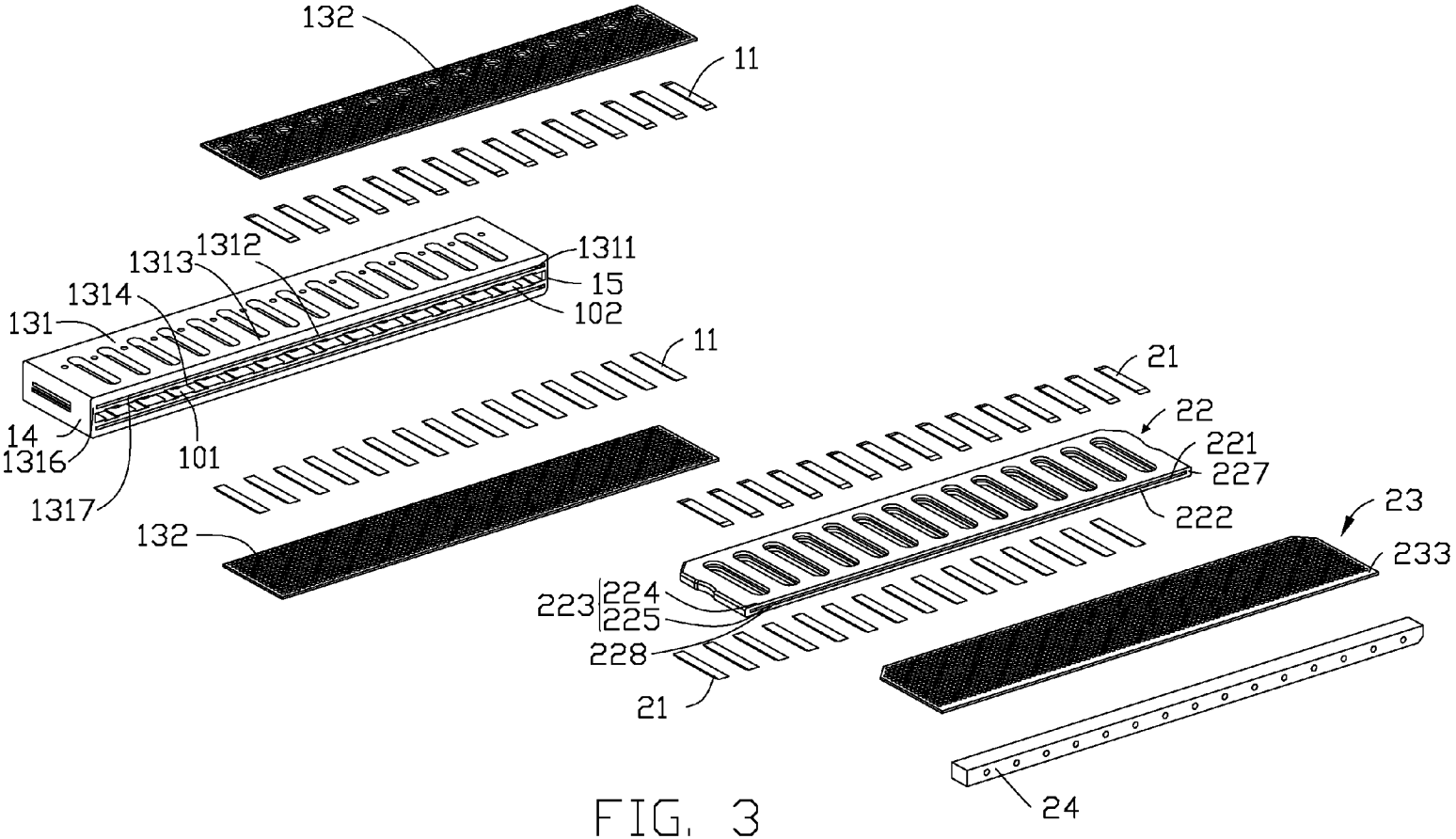
FIG. 3 is similar to FIG. 2, but view from another angle.

FIGS. 1-3 illustrate an embodiment of a connector 1. The connector 1 can include a female connector 10 and a male connector 20. The female connector 10 can be electrically coupled to an electronic device (not shown) or an electronic component (not shown). The female connector 10 can define a receiving space 101 to receive the male connector 20. The female connector 10 can include a number of first electrical terminals 11. The male connector 20 can be electrically coupled to another electronic device (not shown) or another electronic component (not shown). The male connector 20 can include a number of second electrical terminals 21. When the male connector 20 is received in the receiving space 101 of the female connector 10, the first electrical terminals 11 accordingly make electrically contact with the second electrical terminals 21. Thus, an electrical connection can be formed between the female connector 10 and the male connector 20, and the power or signal can be accordingly transmitted between the electronic devices or electronic components.

In the embodiment, the female connector 10 can further include a first sidewall 12 and two resisting members 13. In the embodiment, the first sidewall 12 can be made of electrical insulating material. Each resisting member 13 can include a base plate 131. In the embodiment, each base plate 131 can be made of electrical insulating material. The two base plates 131 can be arranged at opposite ends of the first sidewall 12, and cooperate with the first sidewall 12 to form the receiving space 101. In the embodiment, the two base plates 131 can be respectively substantially perpendicularly protruded from an upper end and a lower end of the first sidewall 12. The first electrical terminals 11 can be received in the receiving space 101 and be secured to the base plates 131.

In the embodiment, the male connector 20 can further include a supporting plate 22 and a first elastic 23. In the embodiment, the supporting plate 22 can be made of electrical insulating material. The supporting plate 22 can define an inner first hollow portion 221. The first elastic 23 can be received in the first hollow portion 221 and resist opposite inner surfaces 222 of the supporting plate 22. The first elastic 23 can be configured to resile the supporting plate 22 outwardly. The second electrical terminals 21 can be attached to opposite outer surfaces 223 of the supporting plate 22. The second electrical terminals 21 can be configured to electrically contact the first electrical terminals 11.

In the embodiment, when connecting the male connector 20 to the female connector 10, the male connector 20 can be inserted into the receiving space 101 of the female connector 10. The first elastic 23 can resile the supporting plate 22 outwardly to resist the two base plates 131. The supporting plate 22 can be accordingly limited in the receiving space 101. Thus, a physical connection can be formed between the female connector 10 and the male connector 20. Simultaneously, the second electrical terminals 21 can electrically contact the first electrical terminals 11 to form a connection between the female connector 10 and the male connector 20.

In the embodiment, each resisting member 13 can include a second elastic 132. Each base plate 131 can define an inner second hollow portion 1311. Each second elastic 132 can be received in a corresponding second hollow portion 1311 and resist opposite inner surfaces 1312 of a corresponding base plate 131. The second elastics 132 can be configured to resile the base plates 131 outwardly and toward each other to resist the opposite outer sidewalls 223 of the supporting plate 22 when the male connector 20 is inserted into the receiving space 101 of the female connector 10, thereby limiting the supporting plate 22 in the receiving space 101. In an alternative embodiment, only one resisting member 13 can include the second elastic 132, and the other resisting member 13 does not include the second elastic 132.

In the embodiment, the construction, shape, and material of the first elastic 23 can be the same as the construction, shape, and material of the second elastic 132. For convenience, only the first elastic 23 can be described below in detail, it being understood that the first elastic 23 and the second elastic 132 are mutually analogous.

Figure 4:
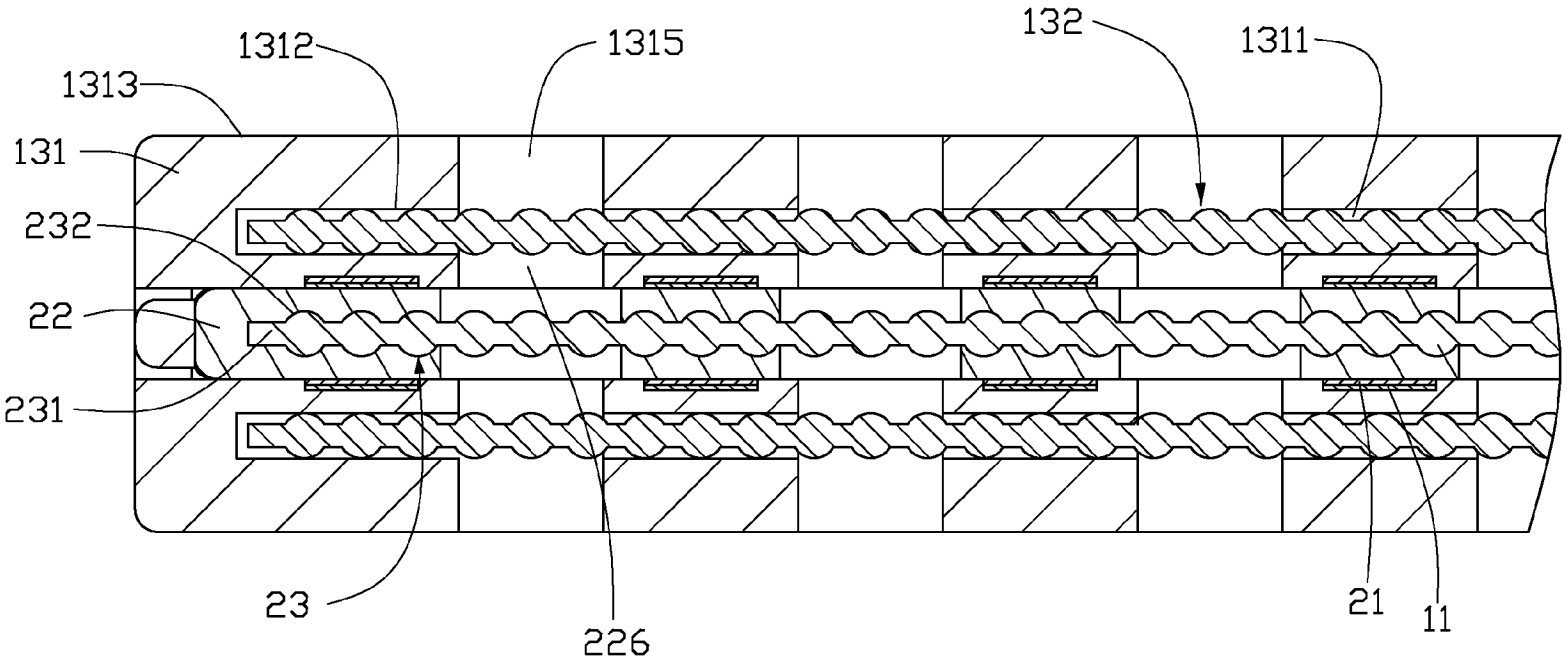
FIG. 4 is a cross-sectional view taken along line IV-IV of FIG. 1.

In the embodiment, the first elastic 23 can include a main body 231 (see FIG. 4) and a number of pellets 232 (see FIG. 4). The pellets 232 can respectively protrude from opposite surfaces 233 of the main body 231 and respectively resist opposite inner surfaces 222 of the supporting plate 22. The pellets 232 can be configured to resile the outer surface 223 of the supporting plate 22 corresponding to the opposite inner surfaces 222 outwardly (see FIG. 4). In the embodiment, the pellets 232 can be made of thermoplastic elastomer. In an alternative embodiment, the first elastic 23 can be made of thermoplastic elastomer.

In the embodiment, the outer surface 223 of the supporting plate 22 can include a first surface 224 and a second surface 225 opposite to the first surface 224. In the embodiment, the first surface 224 of the supporting plate 22 can be an upper surface of the supporting plate 22 and the second surface 225 of the supporting plate 22 can be a lower surface of the supporting plate 22. The first elastic 23 can resile the first surface 224 of the supporting plate 22 and the second surface 225 of the supporting plate 22 outwardly to respectively resist a corresponding base plate 131 when the supporting plate 22 is received in the receiving space 101, thereby limiting the supporting plate 22 in the receiving space 101.

In the embodiment, the supporting plate 22 can further define a number of first slots 226. Each first slot 226 can extend through the first surface 224 of the supporting plate 22 and the second surface 225 of the supporting plate 22. The first slots 226 can be configured to facilitate the supporting plate 22 to curve outwardly.

In the embodiment, the first electrical terminals 11 can be evenly distributed on the two base plates 131. The second electrical terminals 21 can be evenly distributed on the first surface 224 of the supporting plate 22 and the second surface 225 of the supporting plate 22. Each second electrical terminal 21 can correspond to one first electrical terminal 11.

In the embodiment, each base plate 131 can include a first surface 1313 and a second surface 1314 opposite to the first surface 1313. In the embodiment, the first surface 1313 of each base plate 131 can be an upper surface of a corresponding base plate 131 and the second surface 1314 of each base plate 131 can be a lower surface of a corresponding base plate 131. The second elastics 132 can resile the first surface 1313 of a corresponding base plate 131 and the second surface 1314 of another corresponding base plate 131 outwardly and toward each other, to respectively resist the second surface 225 of the supporting plate 22 and the first surface 224 of the supporting plate 22 when the supporting plate 22 is received in the receiving space 101, thereby limiting the supporting plate 22 in the receiving space 101.

In the embodiment, each base plate 131 can define a number of second slots 1315. Each second slot 1315 can extend through the first surface 1313 of a corresponding base plate 131 and the second surface 1314 of the corresponding base plate 131. The second slots 1315 can facilitate the base plates 131 to curve outwardly.

In the embodiment, the supporting plate 22 can further include a sidewall 227. The sidewall 227 of the supporting plate 22 can define a first opening 228. The first opening 228 can be coupled to the first hollow portion 221. The first opening 228 can allow the first elastic 23 to move into the first hollow portion 221.

In the embodiment, the male connector 20 can further include an operating member 24. The operating member 24 can extend along a length direction of the supporting plate 22, and be fixed to the sidewall 227 of the supporting plate 22 at the first opening 228. The operating member 24 can be operated to move the male connector 20 into or out of the receiving space 101.

In the embodiment, the female connector 10 can further include a second sidewall 14 and a third sidewall 15. In the embodiment, the second sidewall 14 and the third sidewall 15 can be made of electrical insulating material. The second sidewall 14 and the third sidewall 15 can be arranged at another opposite ends of the first sidewall 12, and extend between the two base plates 131. In the embodiment, the second sidewall 14 and the third sidewall 15 can respectively substantially perpendicularly protrude from a left end and a right end of the first sidewall 12. The first sidewall 12, the second sidewall 14, the third sidewall 15, and the two base plates 131 can cooperate to form the receiving space 101 and a receiving opening 102. The receiving opening 102 can be coupled to the receiving space 101. The receiving opening 102 can allow the male connector 20 to move into or out of the receiving space 101.

In the embodiment, each base plate 131 can include a first sidewall 1316. The first sidewall 1316 of each base plate 131 can define a second opening 1317. Each second opening 1317 can be coupled to a corresponding second hollow portion 1311. The second opening 1317 can allow the second elastic 132 to move into the second hollow portion 1311. In the embodiment, each base plate 131 can include a second sidewall 1318. The second sidewall 1318 of each base plate 131 can be opposite to the first sidewall 1316 of a corresponding base plate 131. The first sidewall 12 of the female connector 10 can be fixed to the second sidewall 1318 of the base plates 131.

In an alternative embodiment, the female connector 10 can have the second elastic 132, and the first elastic 23 can be excluded from the male connector 20.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A connector comprising:

a female connector comprising a first sidewall, two resisting members, and a plurality of first electrical terminals, each of the two resisting members comprising a base plate, the base plates arranged at opposite ends of the first sidewall and cooperating with the first sidewall to form a receiving space, the first electrical terminals received in the receiving space and secured to the base plates; and a male connector comprising a supporting plate, a first elastic, and a plurality of second electrical terminals, the supporting plate defining an inner first hollow portion, the first elastic received in the first hollow portion and resisting opposite inner surfaces of the supporting plate, the first elastic configured to resile the supporting plate outwardly, the second electrical terminals attached to opposite outer surfaces of the supporting plate and configured to electrically contact the first electrical terminals;

wherein when the male connector is inserted into the receiving space of the female connector, the supporting plate is configured to curve outwardly to resist the base plates, and the second electrical terminals are configured to electrically contact the first electrical terminals to form a connection between the female connector and the male connector.

2. The connector as described in claim 1, wherein the female connector further comprises a second sidewall and a third sidewall, the second sidewall and the third sidewall are arranged at another opposite ends of the first sidewall and extend between the base plates, the first sidewall, the second sidewall, the third sidewall, and the base plates cooperate to form the receiving space and a receiving opening, the receiving opening is coupled to the receiving space, the receiving opening is configured to allow the male connector to move into or out of the receiving space.

3. The connector as described in claim 1, wherein the first elastic comprises a main body and a plurality of pellets; the pellets respectively protrude from opposite surfaces of the main body and respectively resist the opposite inner surfaces of the supporting plate, the pellets are configured to resile the outer surface of the supporting plate corresponding to the opposite inner surfaces outwardly.

4. The connector as described in claim 3, wherein the pellets are made of thermoplastic elastomer.

5. The connector as described in claim 1, wherein at least one resisting member further comprises a second elastic, at least one base plate defines an inner second hollow portion, the at least one second elastic is received in the at least one second hollow portion and resists opposite inner surfaces of the at least one base plate, the at least one second elastic is configured to resile the at least one base plate outwardly to resist an outer sidewall of the supporting plate when the male connector is inserted into the receiving space of the female connector, thereby limiting the supporting plate in the receiving space.

6. The connector as described in claim 5, wherein the at least one second elastic comprises a main body and a plurality of pellets; the pellets respectively protrude from opposite surfaces of the at least one main body and respectively resist opposite inner surfaces of the at least one base plate, the pellets are configured to resile the outer surface of the at least one base plate corresponding to the opposite inner surfaces outwardly.

7. The connector as described in claim 1, wherein the outer surface of the supporting plate comprises a first surface and a second surface opposite to the first surface; the first elastic is configured to resile the first surface of the supporting plate and the second surface of the supporting plate outwardly to respectively resist a corresponding base plate when the supporting plate is received in the receiving space, thereby limiting the supporting plate in the receiving space.

8. The connector as described in claim 7, wherein the supporting plate further defines a plurality of slots; each slot extends through the first surface of the supporting plate and the second surface of the supporting plate, the slots are configured to facilitate the supporting plate to curve outwardly.

9. The connector as described in claim 1, wherein the supporting plate further comprises a sidewall, the sidewall of the supporting plate defines an opening, the opening is coupled to the first hollow portion, and the opening is configured to allow the first elastic to move into the first hollow portion.

10. The connector as described in claim 9, wherein the male connector further comprises an operating member, the operating member extends along a length direction of the supporting plate and is fixed to the sidewall of the supporting plate at the opening, the operating member is operated to move the male connector into or out of the receiving space.

11. A connector comprising:

a female connector comprising a first sidewall, two resisting members, and a plurality of first electrical terminals, each of the two resisting members comprising a base plate and a first elastic, each base plate defining an inner first hollow portion, each first elastic received in a corresponding first hollow portion and resisting opposite inner surfaces of the base plate, the first elastics configured to resile the base plates outwardly and toward each other, the base plates arranged at opposite ends of the first sidewall and cooperating with the first sidewall to form a receiving space, the first electrical terminals received in the receiving space and secured to the base plates; and a male connector comprising a supporting plate and a plurality of second electrical terminals, the second electrical terminals attached to an outer surface of the supporting plate and configured to electrically contact the first electrical terminals;

wherein when the male connector is inserted into the receiving space of the female connector, the base plates are configured to curve outwardly and toward each other to resist opposite outer surfaces of the supporting plate, and the second electrical terminals are configured to electrically contact the first electrical terminals to form a connection between the female connector and the male connector.

12. The connector as described in claim 11, wherein each base plate comprises a first sidewall; the first sidewall of each base plate defines a second opening, each second opening is coupled to a corresponding first hollow portion, the second opening is configured to allow the first elastic to move into the first hollow portion.

13. The connector as described in claim 11, wherein each first elastic comprises a main body and a plurality of pellets; the pellets respectively protrude from opposite surfaces of a corresponding main body and respectively resist opposite inner surfaces of the corresponding base plate, the pellets are configured to resile the outer surface of the corresponding base plate corresponding to the opposite inner surfaces outwardly.

14. The connector as described in claim 13, wherein the pellets are made of thermoplastic elastomer.

15. The connector as described in claim 11, wherein the male connector further comprises a second elastic, the supporting plate defines an inner second hollow portion, the second elastic is received in the second hollow portion and resists opposite inner surfaces of the supporting plate, the second elastic is configured to resile the supporting plate outwardly; the supporting plate is configured to curve outwardly to resist the base plates when the male connector is inserted into the receiving space of the female connector, thereby limiting the supporting plate in the receiving space.

16. The connector as described in claim 15, wherein the second elastic comprises a main body and a plurality of pellets; the pellets respectively protrude from opposite surfaces of the main body and respectively resist the opposite inner surfaces of the supporting plate, the pellets are configured to resile the outer surface of the supporting plate corresponding to the opposite inner surfaces outwardly.

17. The connector as described in claim 15, wherein the supporting plate further comprises a sidewall, the sidewall of the supporting plate defines a first opening, the first opening is coupled to the second hollow portion, the first opening is configured to allow the second elastic to move into the second hollow portion.

18. The connector as described in claim 17, wherein the male connector further comprises an operating member, the operating member extends along a length direction of the supporting plate and is fixed to the sidewall of the supporting plate at the first opening, the operating member is operated to move the male connector into or out of the receiving space.

19. The connector as described in claim 11, wherein each base plate comprises a first surface and a second surface opposite to the first surface; the first elastics are configured to resile the first surface of a corresponding base plate and the second surface of another corresponding base plate outwardly and toward each other to respectively resist the second surface of the supporting plate and the first surface of the supporting plate when the supporting plate is received in the receiving space, thereby limiting the supporting plate in the receiving space.

20. The connector as described in claim 19, wherein each base plate further defines a plurality of slots, each slot extends through the first surface of a corresponding base plate and the second surface of the corresponding base plate, the slots are configured to facilitate the base plate to curve outwardly.

* * * * *